US007101345B1

(12) United States Patent
Liu

(10) Patent No.: US 7,101,345 B1
(45) Date of Patent: Sep. 5, 2006

(54) FINGER ACUPRESSURE APPARATUS

(76) Inventor: Chin Chia Liu, 275 E.6th St., #120, Tustin, CA (US) 92780

( * ) Notice: Subject to any disclaimer, the term of this patent is extended or adjusted under 35 U.S.C. 154(b) by 0 days.

(21) Appl. No.: 10/924,608

(22) Filed: Aug. 23, 2004

(51) Int. Cl.
*A61H 19/00* (2006.01)

(52) U.S. Cl. ..... 601/133; 601/134; 601/135

(58) Field of Classification Search ..... 601/28, 601/40, 61, 84, 95, 103, 108–111, 133–135, 601/151–152
See application file for complete search history.

(56) References Cited

U.S. PATENT DOCUMENTS

| | | | | |
|---|---|---|---|---|
| 3,866,597 | A | 2/1975 | Boxer | |
| 3,886,939 | A | 6/1975 | Boxer | |
| 4,022,189 | A | 5/1977 | Boxer | |
| 4,479,495 | A * | 10/1984 | Isaacson | 606/204 |
| 4,516,774 | A | 5/1985 | Nankivell | |
| 4,944,289 | A * | 7/1990 | Matthews | 601/134 |
| 5,549,294 | A | 8/1996 | Wellen et al. | |
| 5,709,647 | A * | 1/1998 | Ferber | 601/134 |
| 5,938,684 | A | 8/1999 | Lynch et al. | |
| 6,039,703 | A * | 3/2000 | Badilla | 601/61 |
| 6,234,919 | B1 | 5/2001 | Mizeracki et al. | |
| 6,458,146 | B1 | 10/2002 | Kramer | |
| 6,669,657 | B1 | 12/2003 | Ongwela | |
| 2003/0001064 | A1* | 1/2003 | Book | 248/460 |
| 2003/0045899 | A1 | 3/2003 | Yoo | |
| 2004/0088036 | A1 | 5/2004 | Gilbert | |

* cited by examiner

*Primary Examiner*—Michael A. Brown

(57) ABSTRACT

A finger acupressure apparatus comprising a pair of upper and lower pressing plates configured with adjustable distance therebetween and at least one acupressure element on an inner side of the plates enabling for compressing against fingers or the palm muscle for physical therapy purposes.

3 Claims, 7 Drawing Sheets

FINGER ACUPRESSURE APPARATUS

FIELD OF THE INVENTION

The present invention generally relates to a finger acupressure massaging apparatus and methods of use. More particularly, the present invention relates to a handheld finger acupressure apparatus for compressing against fingers or the palm muscle creating pressure stimulating effects for physical therapy purposes.

BACKGROUND OF THE INVENTION

Acupressure is a form of treatment for various conditions and maladies. It was generally believed that there are patterns of energy flow through the body that are essential for proper health maintenance. Imbalance or disruption of energy flow through any of these patterns is believed to be responsible for diseases. The energy flow patterns through the body have been mapped extensively and there are substantial numbers of points, called "sheh" herein, along the flow patterns where the energy flow is close to the skin surface. In one aspect, acupressure is to apply stimulation at that "sheh" point to modulate the flow of energy and modify the dynamics in the energy flow. When done properly, acupressure therapy rejuvenates the energy flow to one of balance and restoration of health.

Thus, acupressure therapy is a simple inexpensive technique, with virtually no negative side effects, that could greatly enhance the treatment of many health conditions if it were readily available to the lay public. Acupressure is a direct offshoot of acupuncture wherein one or more known points on the surface of the skin receive pressure instead of having a needle inserted. The concept remains the same. It is to re-institute balanced energy flow as treatment of a malady caused by an imbalance in the energy flow through the body. Western medical research has also shown physiological effects, including reflexes and neurohumoral effects of acupuncture and acupressure in human subjects. Several acupressure devices are known in the art, for example, see U.S. Pat. Nos. 3,866,597, 3,886,939, 3,987,787, and 4,022,189, all issued to Boxer. The devices disclose make and use of one or more small rigid objects that are applied by the user to one or more particular points of the user's body.

The benefits of massage and acupressure have been known for centuries. Massage as a form of therapy has been used by almost all cultures for thousands of years, dating back to the ancient Greeks and Romans where Hippocrates extolled its virtues as a form of medical treatment. There are currently over 100 different types of massage therapy being practiced today. Acupressure is a specific type of massage, dating back over 5,000 years in ancient China. The technique consists of applying localized pressure to specific points (that is, "sheh" as defined herein) on the body as opposed to acupuncture which inserts needles into these same points. The effects of acupressure and acupuncture are similar. Studies have demonstrated that acupuncture stimulates the nervous system, causing alterations in the amount of neurotransmitters and/or neurohormones released, thus resulting in changes in blood flow, immune function and/or pain perception. The effects of massage and acupressure such as reduction in pain, muscle tension and stress are well documented.

Other physical methods which have been scientifically proven to reduce pain and muscle spasm include physical modalities such as applying heat or cold. In addition, recent medical studies have demonstrated that treatment with magnetic fields reduces muscular pain and is useful in treating persistent neck pain. Treatment with these types of modalities typically requires daily treatment. In fact, most types of pain and spasm respond better to daily treatment whether it is by physical modalities or massage. Indeed, many instructors of ancient healing arts and physical therapists instruct their clients on self management of pain using techniques of self massage, self acupressure or other self administered physical modalities. Thus, it is advantageous to be able to self-treat the painful area with a simple apparatus.

U.S. Patent Application publication No. 2004/0088036, the entire contents of which are incorporated herein by reference, discloses a disc shaped device having two primary layers. A first layer has one side, which is the lower side in use, for adhering to a patient's skin surface, a second, upper layer on the underside of which electrical circuitry is printed or affixed so that the electrical circuitry is sandwiched between the layers.

U.S. Patent Application publication No. 2003/0045899, the entire contents of which are incorporated herein by reference, discloses an acupressure device for each finger designed to be inserted by the end of the finger in order to provide pressure stimulation effects with protuberances of the inner surface of the device. The acupressure device for fingers includes an inserting unit for the end of a finger to be inserted, at one side, a cutting unit in a center of the inserting unit, a semi-circular base unit having a flat outer surface and an inner surface cast into a plurality of protuberances, and two fixing strips at both sides of the semi-circular base unit.

U.S. Pat. No. 6,458,146, the entire contents of which are incorporated herein by reference, discloses an acupressure device for use on a selected skin surface portion of a human body. The device comprises a base sheet, one or more protrusions, a fastener, and an orienting margin, orienting constellation, orienting template or orienting protrusion, suitable to position the device on the selected skin surface. The invention also provides therapeutic methods comprising applying a devise of the invention to a human in need of therapy.

U.S. Pat. No. 4,516,774, the entire contents of which are incorporated herein by reference, discloses a hand paddle for a paddle ball game including a back member with a back surface which is conformed generally to the shape of either a user's right or left hand. The paddle includes a contoured palm support region, a plurality of elongated finger receiving depressions extending from the palm support region and a thumb manipulation region adjacent to the palm support region and the elongated finger receiving depressions. Each elongated depression has a finger gripping ridge transverse thereto at a distal location relative to the palm support region for being gripped by the end of the finger positioned in that elongated depression. Retention straps, including finger straps, crisscrossed hand straps and a crisscrossed wrist strap are attached to the back member for holding the hand paddle on the user's hand.

U.S. Pat. No. 5,549,294, the entire contents of which are incorporated herein by reference, discloses a hand paddle that has first and second paddle members which are spaced apart to receive a user's hand therein, and which each have a top portion, a bottom portion, and outer and inner surfaces. This paddle includes post members for connecting the paddle members together in a manner which maintains the outer surfaces in substantially parallel alignment. It also has first and second compressible layers positioned on the inner surfaces of the first and second paddle members, respec tively. These layers are spaced apart and face each other with the spacing between the layers at the top portion of the paddle members being less than the spacing between the layers at the bottom portion of the paddle members so that a user's hand is snugly received therebetween.

U.S. Pat. No. 6,234,919, the entire contents of which are incorporated herein by reference, discloses a table tennis handle-less paddle or racquet. A racquet is characterized by combination of two separate impact surfaces, between which a player's hand is inserted. The accessories and games are specifically designed as an integrated package, to develop motor skills for the young players, and to facilitate learning table tennis, starting from age five to six.

U.S. Pat. No. 5,938,684, the entire contents of which are incorporated herein by reference, describes an appliance for therapeutic pressure application, the appliance comprising at least one protuberance each having a base end anchored to a resilient medium and a point end for applying pressure to tissue, the medium having resilient, flexible and insulating properties to absorb the pressure between the point ends and the tissue so as to prevent pain, cut or penetration of the tissue by the point ends and to retain the heat generated by the tissue.

U.S. Pat. No. 6,669,657, the entire contents of which are incorporated herein by reference, describes a massage and tactile stimulation device in the nature of a hand covering such as a mitt, mitten, or glove to be worn on the hand of a masseur, therapist, or user preferably in the embodiment of a glove. The device having one or more predetermined prominent projections with or without friction areas. Both projections and friction areas may be of various shapes, sizes, colors, forms, and textures including smooth or pimpled. Both projections and friction areas are secured to effective working areas of glove to impart to a subject or patient a variety of distinct and improved manipulations such as deep pressure, grasping, and frictional rubbing.

The prior art teaches a conventional palm or singular finger acupressure apparatus that provides massage therapy for a patient. None of them discloses a simple stimulating finger apparatus with at least a surface comprising a plurality of protuberances configured for compressing against the fingers or palm muscle so as to stimulating and modulating the energy flow at about the skin surface. What is needed is a device that is relatively inexpensive, which can be applied by the user with both massage and exercise effects.

SUMMARY OF THE INVENTION

It is one object of the present invention to provide a finger acupressure stimulating apparatus to overcome the disadvantages of the conventional devices.

Some aspects of the invention relate to a finger acupressure apparatus comprising: an upper plate having a first end and an opposite second end, a lower plate having a first end and an opposite second end, the first end of the upper plate is connected to the first end of the lower plate with a connecting means for adjustably connecting the two plates configured to exert essentially uniform pressure against inserted fingers for finger acupressure massage.

In a further embodiment, any of the upper plate or the lower plate of the apparatus comprises an exchangeable acupressure unit with protuberances on an outer surface, an inner surface, or both surfaces of the plate.

In a further embodiment, any of the upper plate or the lower plate comprises an exchangeable acupressure unit with protuberances on an inner or outer surface of the plate, and wherein an end section of the protuberances is a round shape or a blunt shape. In a further embodiment, the protuberances are made of semi-rigid material.

In a further embodiment, any of the upper plate or the lower plate comprises a sliding rail for sliding an exchangeable acupressure unit on the rail.

In a further embodiment, the connecting means of the finger acupressure apparatus comprises a plurality of raised buttons and their matching receiving slots. In an alternate embodiment, the connecting means comprises a retention strap, an elastic strap, or a spring.

Some aspects of the invention relate to a handheld compressing apparatus comprising: an upper plate having a first end and an opposite second end, a lower plate having a first end and an opposite second end, the first end of the upper plate is connected to the first end of the lower plate with a connecting means for adjustably connecting the two plates configured to exert appropriate pressure against an inserted nut for crushing the nut.

Some aspects of the invention relate to a handheld compressing apparatus comprising: an upper plate having a first end and an opposite second end, a lower plate having a first end and an opposite second end, the first end of the upper plate is connected to the first end of the lower plate with a connecting means for adjustably connecting the two plates configured to exert appropriate pressure against an inserted bottle cap of a bottle for opening the bottle.

BRIEF DESCRIPTION OF THE DRAWINGS

Further features and advantages of the present invention will become apparent to one of skill in the art in view of the Detailed Description of Exemplary Embodiments that follows, when considered together with the attached drawings and claims.

DETAILED DESCRIPTION OF EXEMPLARY EMBODIMENTS

The preferred embodiments of the present invention described below relate particularly to a handheld finger acupressure apparatus comprising a pair of upper and lower pressing plates configured with adjustable distance therebetween and at least one acupressure element on an inner side of the plates enabling for compressing against fingers or the palm muscle for physical therapy purposes. While the description sets forth various embodiment specific details, it will be appreciated that the description is illustrative only and should not be construed in any way as limiting the invention. Furthermore, various applications of the invention, and modifications thereto, which may occur to those who are skilled in the art, are also encompassed by the general concepts described below.

The "sheh" is herein intended to mean a point along the flow patterns where the energy flow is close to the skin surface. In one aspect, acupressure is to apply pressure and stimulation at that "sheh" point to modulate the flow of energy and modify the dynamics in the energy flow.

Figure 1:
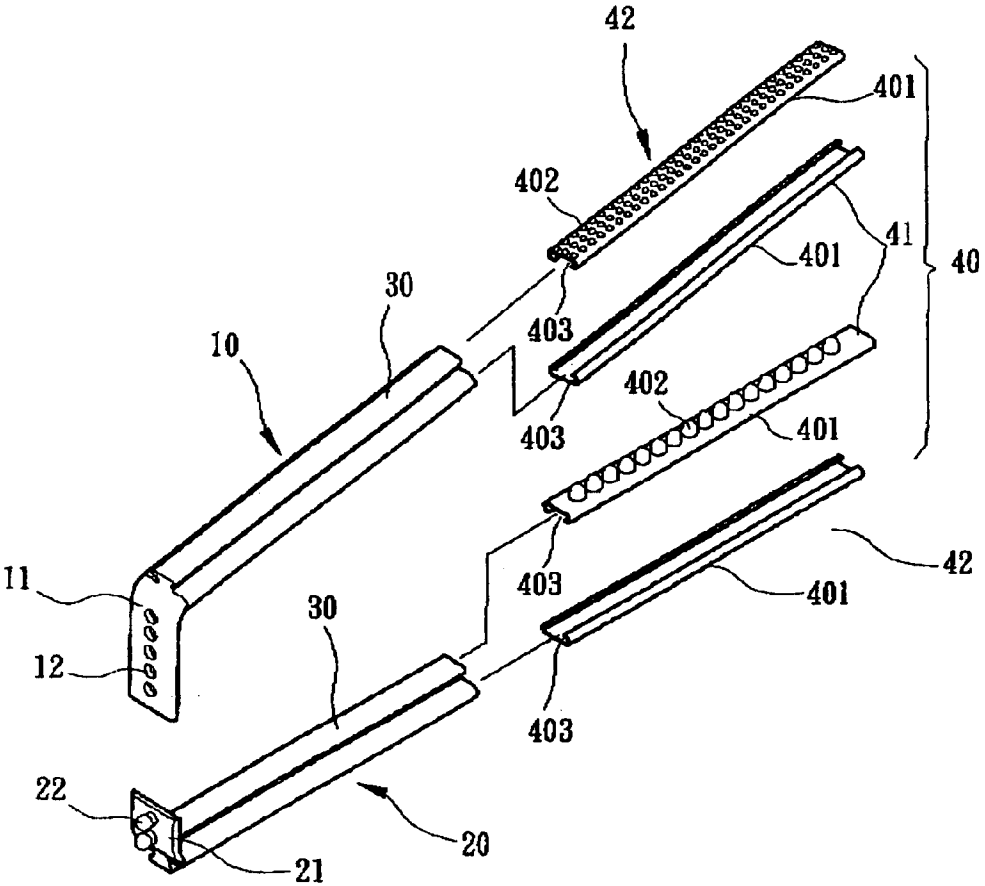
FIG. 1 is an exploded perspective view showing the components and subassemblies of the finger acupressure apparatus.
Figure 2:
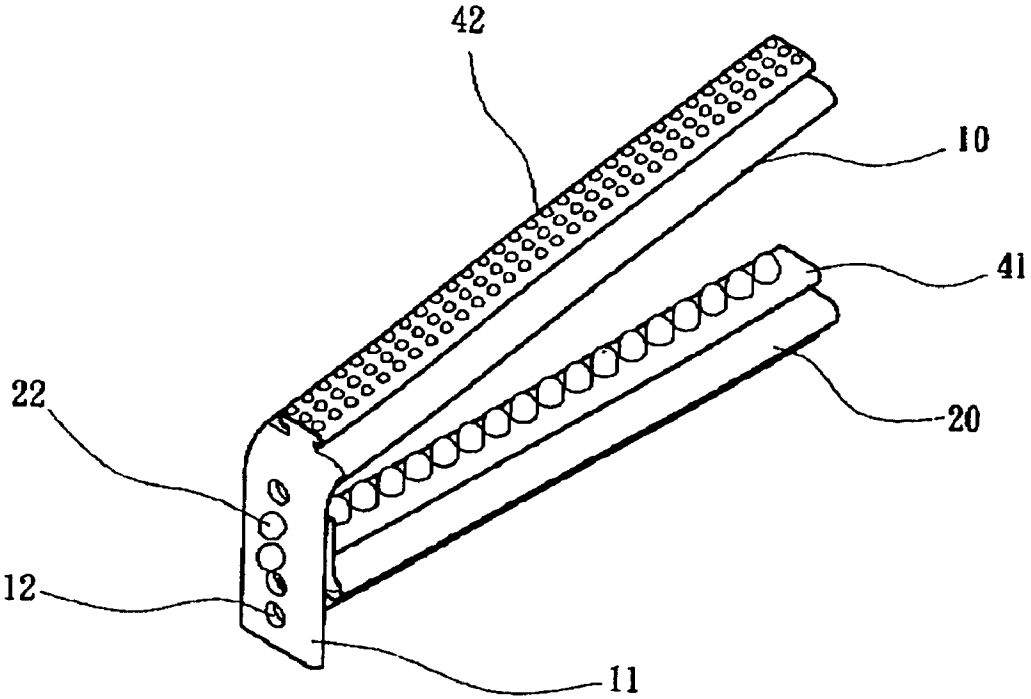
FIG. 2 is a perspective view of a finger acupressure apparatus according to the principles of the present invention.

Referring to FIGS. 1–2, what is shown is an embodiment comprising a finger acupressure apparatus having an upper pressing plate 10 and a lower pressing plate 20, each having an inner surface facing each other and an outer surface. In one embodiment, at least one inner surface comprises a plurality of protuberances 402 or protruding pillars sized, shaped, and configured for compressing against the finger or palm muscle when the two inner surfaces are pushed against each other. In another embodiment, a first and a second compressible layers are positioned on the inner surfaces of the upper and lower plates, respectively. These layers are spaced apart and face each other with the spacing between the layers sized and configured for inserting at least one finger or a palm for acupressure massage.

The end section of the protuberances 402 or protruding pillars may be a round, blunt or other shape according to the need of an individual. The length of the pillars is sized, spaced, and configured to fit the need and the contours of the individual's finger or palm. By way of examples, the pillar height (that is, length) is higher at about the edge of the inserted finger than at the middle of the finger region so as to intimately contact most of the "sheh" points on a finger for stimulation and massage. The pillars are constructed with an essentially semi-rigid material and sized to apply appropriate pressure against the muscle skin or "sheh". The pillars are also spaced apart and configured to impart appropriate pressure at about the clusters of "sheh" on the fingers or the palm of an individual.

Figure 3:
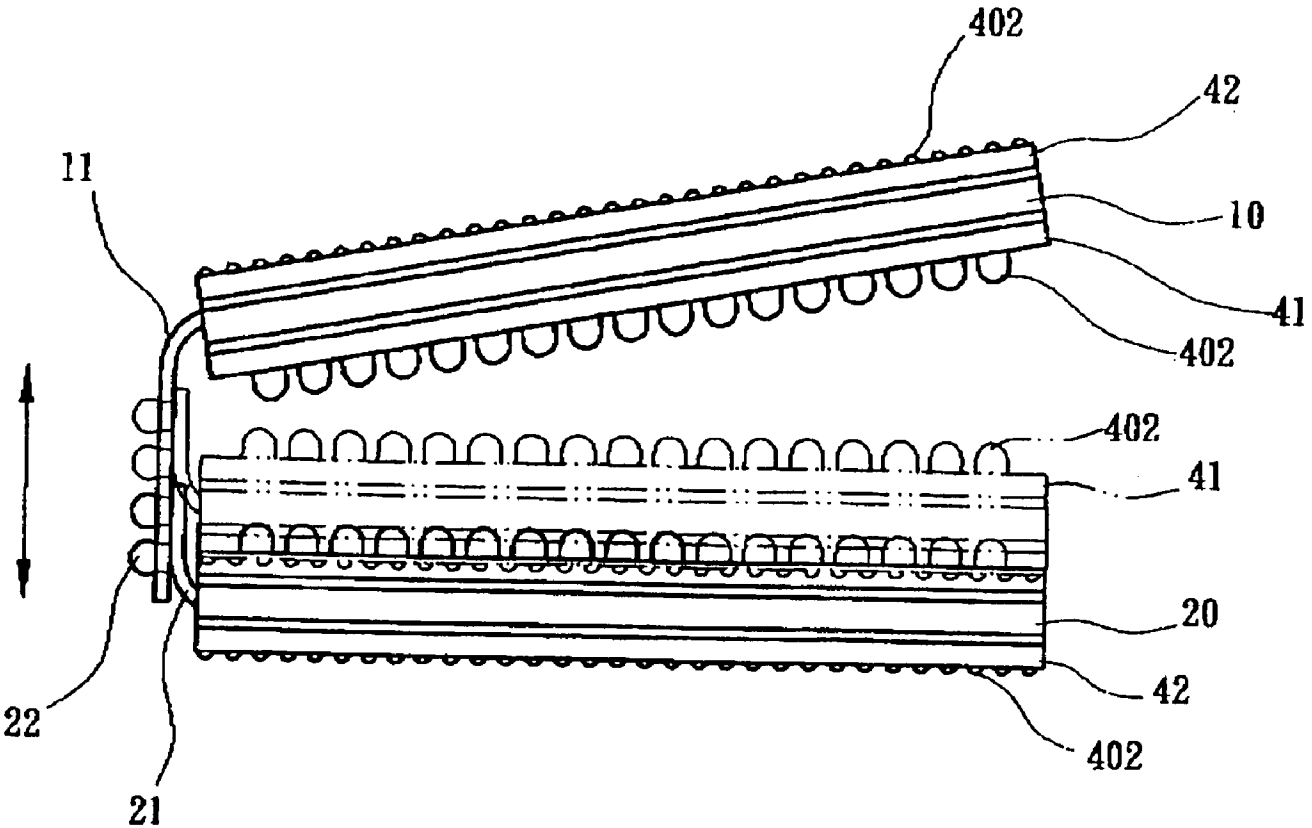
FIG. 3 is a side view illustrating means for adjusting the space between the upper and the lower plates of the finger acupressure apparatus of FIG. 2.

The upper plate has its first end and an opposite second end whereas the lower plate has its first end and an opposite second end. There is provided a pair of adjustable connecting members 11, 21 at the first ends of the upper plate and lower plate, respectively. FIG. 3 shows a side view illustrating means for adjusting the space between the upper and the lower plates of the finger acupressure apparatus of FIG. 2. In one embodiment, the connecting members have raised buttons 22 and their matching receiving slots 12 for connecting the two plates with a desired spacing between the plates. Other means for adjustably connecting the two plates securely (such as a retention strap, an elastic strap, a spring or the like) are also applicable. In one embodiment, the two plates are about in parallel to each other.

In a further embodiment, the inner side of each plate is equipped with a sliding rail 30 configured for receiving the acupressure units 40 or the compressing unit 50, wherein the acupressure unit 40 comprises an inner acupressure element with a first type of protuberances 41 or an outer acupressure element with a second type of protuberances 42. In some embodiments, the acupressure unit 40 comprises an appropriate troughened member 401 with a trough 403 configured for riding over the rail of the sliding rail 30. In a preferred embodiment, the inner acupressure element exerts its first type of protuberances onto the inserted finger of one hand while the outer acupressure element exerts its second type of protuberances onto the holding palm when the second hand holds the apparatus firmly.

Figure 4:
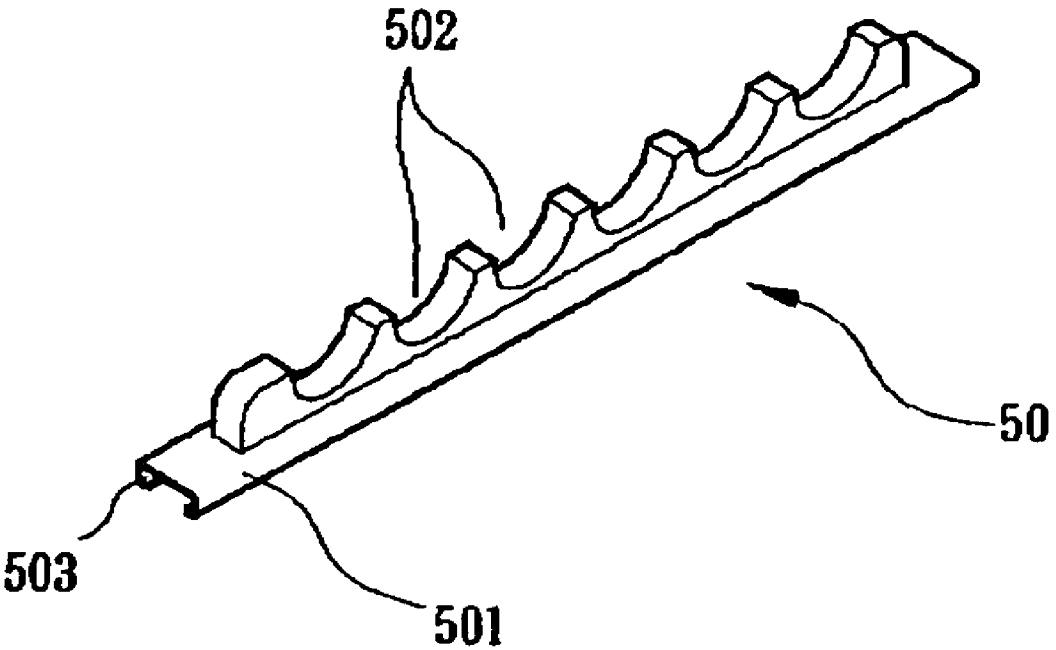
FIG. 4 shows one embodiment of the acupressure elements with protuberances.

FIG. 4 shows one embodiment of the acupressure elements with protuberances. By way of examples, the compressing unit 50 comprises a troughened member 501 with a trough 503 on one side (that is, the outer side) and a plurality of semi-circular concave surfaces 502 on the opposite side (that is, the inner side). The compressing unit is configured for riding over the rail of the sliding rail 30.

Figure 5:
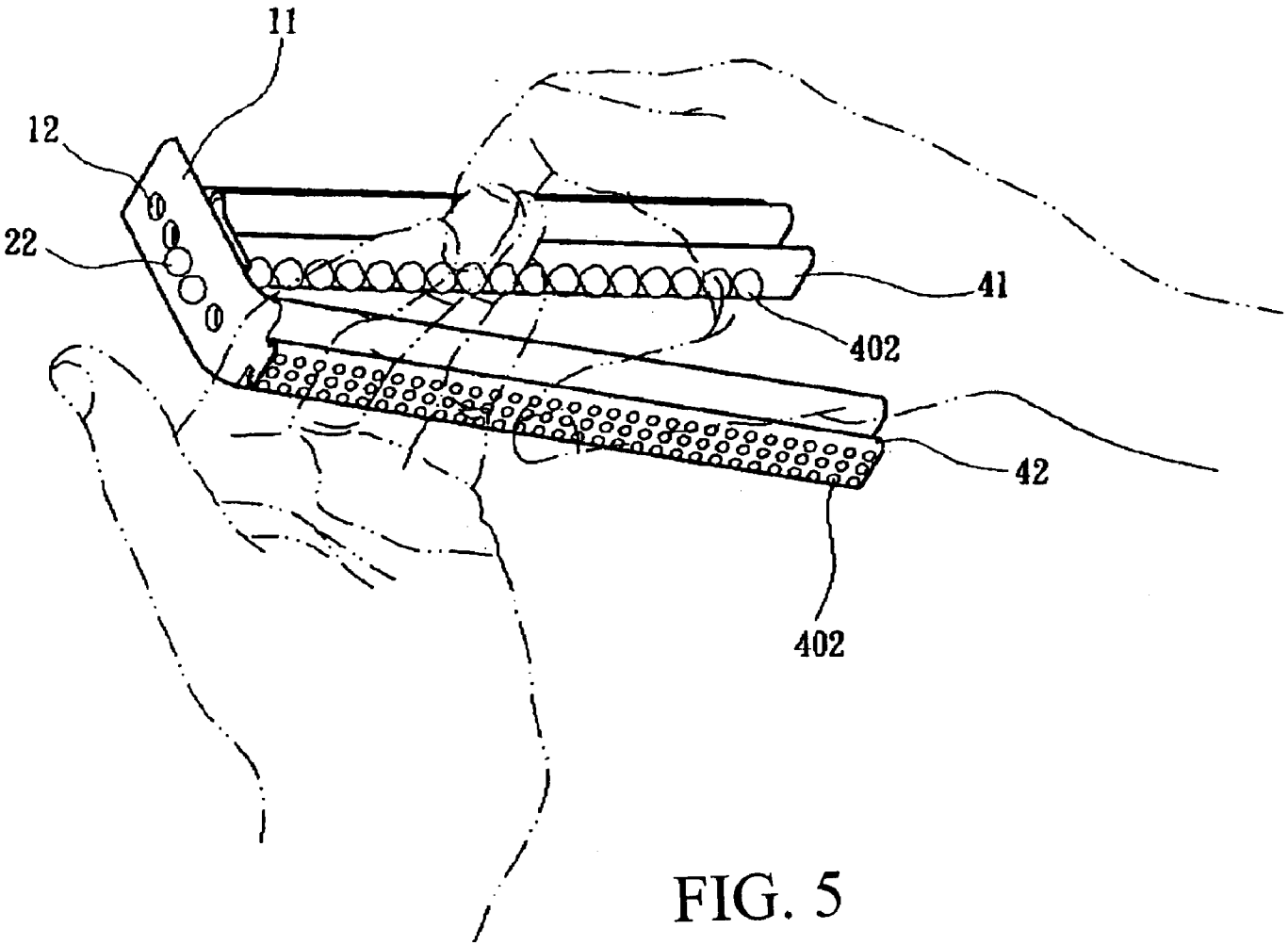
FIG. 5 is a perspective view of the finger acupressure apparatus performed by an individual on his fingers.

FIG. 5 shows a perspective view of the finger acupressure apparatus performed by an individual on his fingers or other's fingers. In use, the individual takes the finger acupressure apparatus having the upper plate 10 and the lower plate 20. Then he adjusts the apparatus with an appropriate spacing according to the finger characteristics for receiving and holding user's fingers snugly between the surface of the two plates configured to exert some acupressure for massage and stimulation. The adjusting step is carried out by matching the raised buttons 22 and their matching receiving slots 12 for connecting the two plates with a desired or intended spacing between the plates.

Figure 6:
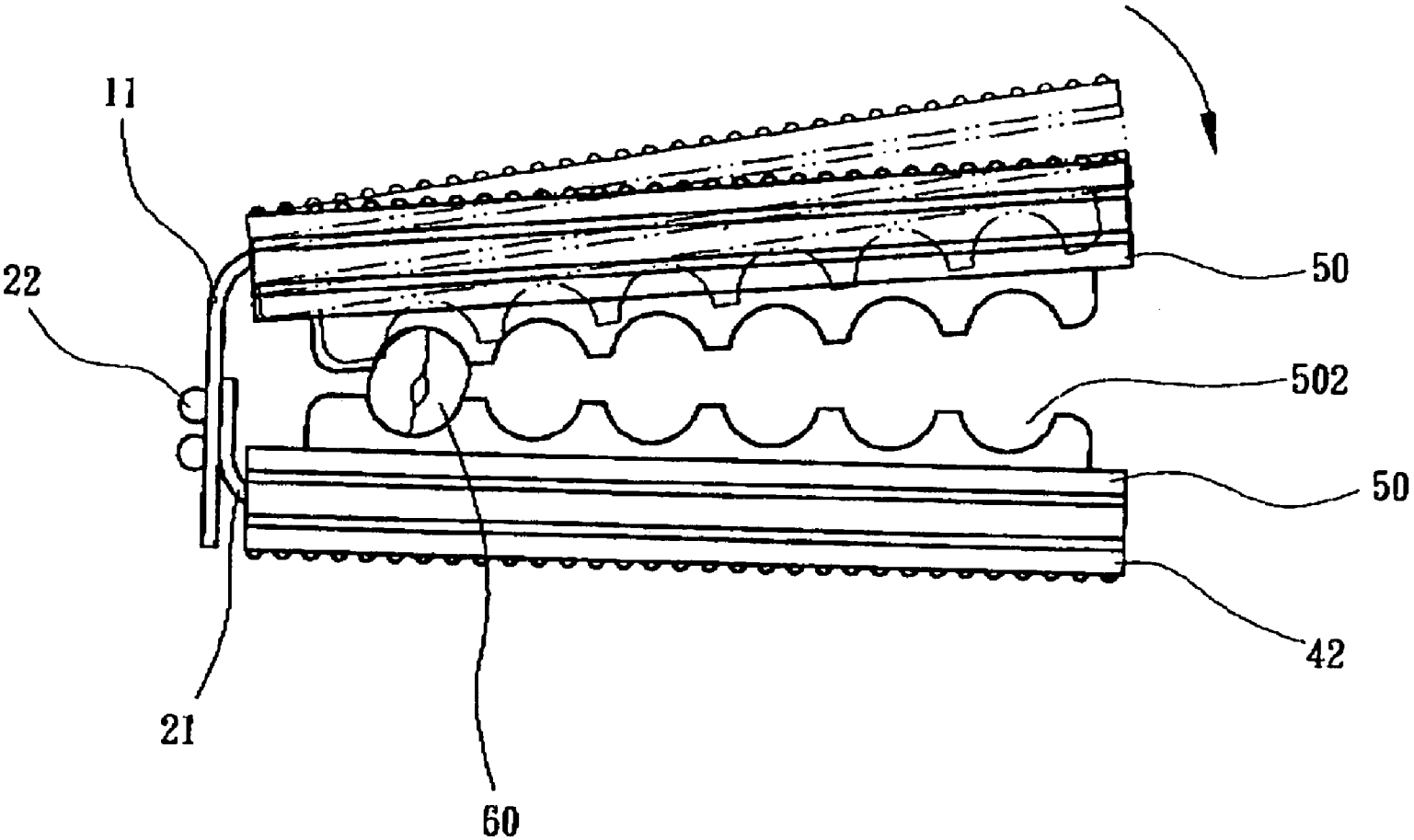
FIG. 6 shows another embodiment of the apparatus with protuberances on each compressing element.
Figure 7:
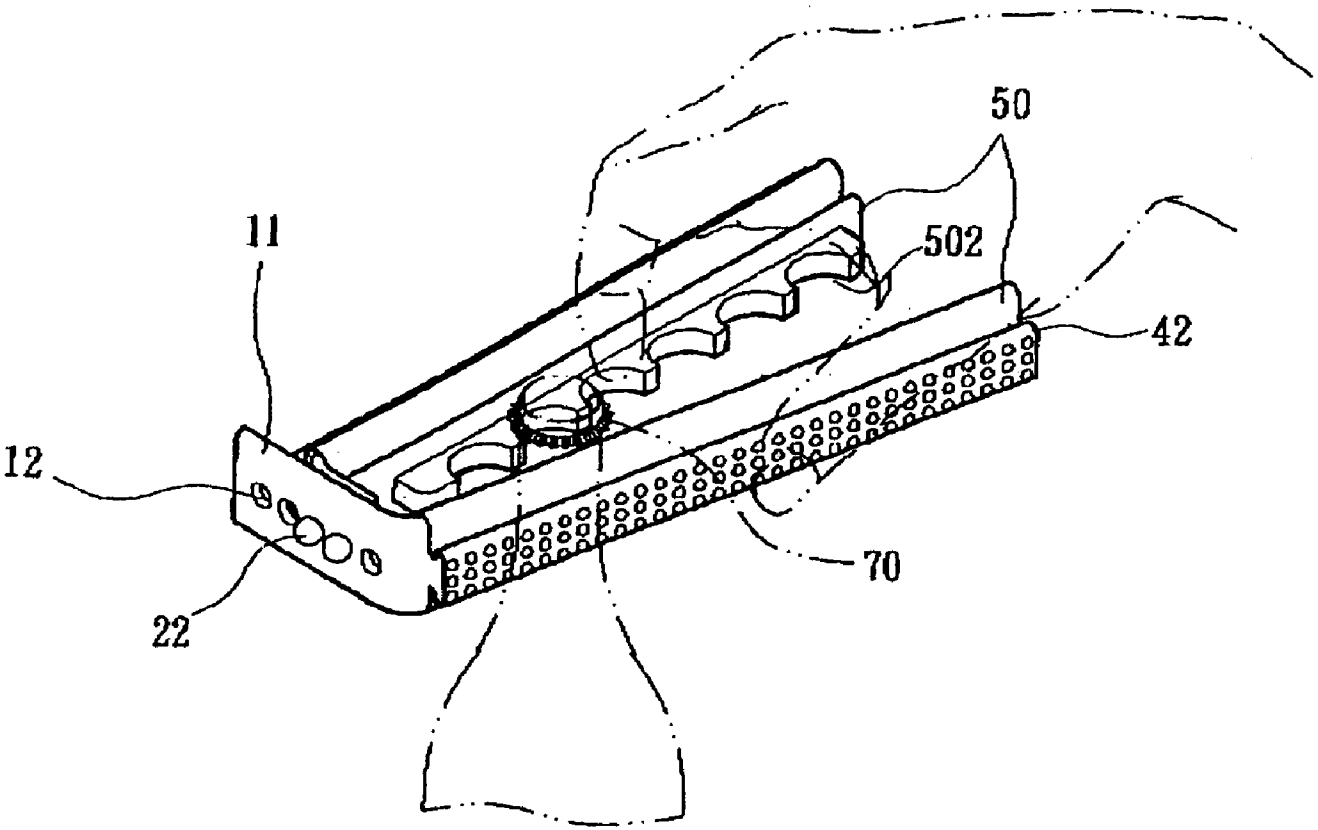
FIG. 7 shows a perspective view of the apparatus of the present invention for opening a bottle cap.

FIG. 6 shows another embodiment of the apparatus with protuberances on each compressing element whereas FIG. 7 shows a perspective view of the apparatus of the present invention for opening a bottle cap or crushing a nut 60. The compressing unit 50 comprises a troughened member 501 with a trough 503 on the outer side and a plurality of semi-circular concave surfaces 502 on the inner side. In one embodiment, the circle formed by closing the two troughened members 501 is configured to hold the bottle cap enabling to open the bottle. In another embodiment, the circle formed by closing the two troughened members 501 is configured to crush a hard nut, such as walnut, chestnut or the like enabling to release the edible contents of the nut. The protuberances in this case are constructed with an essentially rigid material and sized to apply appropriate pressure against the shells of the nuts. As described above, the outer acupressure element exerts its second type of protuberances onto the holding palm when the second hand grasps and presses the two plates toward each other firmly.

From the foregoing description, it will be appreciated that a finger acupressure apparatus comprising a pair of compressible plates with an inner surface comprising a plurality of protruding pillars configured for compressing against the finger muscle enabling stimulating and modulating the energy flow at about the finger skin has been disclosed. While aspects of the invention have been described with reference to specific embodiments, the description is illustrative and is not intended to limit the scope of the invention. Various modifications and applications of the invention may occur to those who are skilled in the art, without departing from the true spirit or scope of the invention. The breadth and scope of the invention should be defined only in accordance with the appended claims and their equivalents.

What is claimed is:

1. A finger acupressure apparatus comprising: an upper plate having a first end and an opposite second end, a lower plate having a first end and an opposite second end, said first end of the upper plate is connected to the first end of the lower plate with a connecting means for swinging open a gap between the upper plate and the lower plate, wherein any of the upper plate or the lower plate comprises an exchangeable acupressure unit having at least one recess opening configured to receive at least one finger when the gap is swung open and exert pressure against said at least one finger for finger acupressure massage, wherein any of the upper plate or the lower plate comprises a sliding rail for sliding an exchangeable acupressure unit on said rail.

2. The finger acupressure apparatus according to claim 1, wherein said exchangeable acupressure unit comprises pro tuberances on an inner surface, an outer surface or both surfaces of the plate.

3. A finger acupressure apparatus comprising: an upper plate having a first end and an opposite second end, a lower plate having a first end and an opposite second end, said first end of the upper plate is connected to the first end of the lower plate with a connecting means for swinging open a gap between the upper plate and the lower plate, wherein any of the upper plate or the lower plate comprises an exchangeable acupressure unit having at least one recess opening configured to receive at least one finger when the gap is swung open and exert pressure against said at least one finger for finger acupressure massage, wherein the connecting means comprises a plurality of raised buttons and their matching receiving slots.

* * * * *